US006260394B1

(12) United States Patent
Haraga et al.

(10) Patent No.: US 6,260,394 B1
(45) Date of Patent: Jul. 17, 2001

(54) FORMING METHOD, FORMING TOOLS AND ELASTIC PUNCH

(75) Inventors: Yoshio Haraga; Masami Iwamoto, both of Kanagawa (JP)

(73) Assignee: Amada Company, Limited, Kanagawa-Ken (JP)

( * ) Notice: Subject to any disclaimer, the term of this patent is extended or adjusted under 35 U.S.C. 154(b) by 0 days.

(21) Appl. No.: 09/506,028

(22) Filed: Feb. 17, 2000

Related U.S. Application Data

(63) Continuation of application No. 09/196,342, filed on Nov. 19, 1998, now Pat. No. 6,029,486, which is a continuation-in-part of application No. 09/064,880, filed on Apr. 23, 1998, now Pat. No. 5,966,976.

(30) Foreign Application Priority Data

Nov. 19, 1997 (JP) ..... 9-317869
Feb. 6, 1998 (JP) ..... 10-25274

(51) Int. Cl.[7] ..... B21D 22/10
(52) U.S. Cl. ..... 72/57; 72/60
(58) Field of Search ..... 72/57, 58, 60, 72/54, 56, 466.8, 465.1

(56) References Cited

U.S. PATENT DOCUMENTS

| | | | | |
|---|---|---|---|---|
| 562,309 | * | 6/1896 | Leavenworth | 72/58 |
| 2,234,225 | * | 3/1941 | Becker | 72/60 |
| 2,438,837 | * | 3/1948 | Archer et al. | 72/58 |
| 2,606,516 | * | 8/1952 | Raynes | 72/57 |
| 2,783,727 | * | 3/1957 | Hoffman | 72/60 |
| 2,966,873 | * | 1/1961 | Hoffman et al. | 72/58 |
| 3,382,690 | * | 5/1968 | Achler et al. | 72/58 |
| 3,757,718 | * | 9/1973 | Johnson | 72/354.8 |
| 5,081,859 | * | 1/1992 | De Smet | 72/57 |
| 5,205,146 | * | 4/1993 | Wilkens et al. | 72/57 |
| 5,490,407 | * | 2/1996 | Doose | 72/57 |
| 5,599,565 | * | 2/1997 | Dittlo | 425/384 |
| 5,966,976 | * | 10/1999 | Haraga | 72/57 |
| 6,029,486 | * | 2/2000 | Haraga et al. | 72/57 |

FOREIGN PATENT DOCUMENTS

| | | |
|---|---|---|
| 1752706 | 3/1971 | (DE) . |
| 1248553 | 10/1971 | (GB) . |

* cited by examiner

*Primary Examiner*—David Jones
(74) *Attorney, Agent, or Firm*—Blank Rome Comisky & McCauley, LLP

(57) ABSTRACT

A forming method of forming a plate-shaped workpiece using a female tool having a concave section of a desired shape and a male tool which matches with the female tool, includes the following steps: providing an elastic punch in a cylindrical holder provided in the male tool; pressurizing and compressing the elastic punch relatively by a pressuring member; pressing the holder against the workpiece by means of one portion of the elastic punch; and projecting one portion of the elastic punch from the holder so as to deform a portion of the workpiece to be processed according to the shape of the concave section of the female tool so that the workpiece is formed in a state such that the workpiece is nipped pressingly between the female tool and the holder.

2 Claims, 14 Drawing Sheets

FORMING METHOD, FORMING TOOLS AND ELASTIC PUNCH

RELATED APPLICATIONS

This application is a continuation of application Ser. No. 09/196,342, filed Nov. 19, 1998 now U.S. Pat. No. 6,029, 486, which, in turn is a continuation-in-part of application Ser. No. 09/064,880, filed Apr. 23, 1998 (now U.S. Pat. No. 5,966,976), the disclosures of which are hereby incorporated herein by reference.

BACKGROUND OF THE INVENTION

1. Field of the Invention

The present invention relates to a forming method for performing a forming process such as drawing works such as metal plates into a predetermined shape utilizing an elastic punch made of an elastic material, and relates to forming tools and an elastic punch utilized in the method and tools.

2. Description of the Related Art

Conventionally, in the case where a forming process such as drawing plate-shaped works using a punching press, for example, a die (female tool) having a concave section matching with a shape of the forming process and a punch (male tool) matching with the concave section are mounted to the punching press, and a workpiece is positioned between the die and punch. Thereafter, the punch is lowered, and the workpiece is formed into a desired shape by the die and punch. Here, occasionally a punch is used as a female tool and a die is used as a male tool.

In the case where a punch and a die are mounted to a punching press or the like and a plate-shaped workpiece is formed in the conventional manner, special tools which match with a shape of a forming process is required. Therefore, there arises a problem that if works are formed into various shapes by forming process, a lot of tools which matches with the various shapes of the forming process are required.

Further, even if works are formed into an uniform shape by the forming process, when thickness of the workpieces are varied, a clearance between the punch and die should be adjusted according to the various thicknesses. Therefore, there arises a problem that the adjustment according to the various thicknesses is troublesome.

SUMMARY OF THE INVENTION

The present invention has been achieved with such points in mind.

It therefore is an object of the present invention to provide a forming method and forming tools where manufacturing costs can be reduced.

It is another object of the present invention to provide a forming method and forming tools where the process of forming a workpiece can be performed in a simple structure.

It is still another object of the present invention to provide an elastic punch to be used in forming tools where the elastic punch can easily cope with the change in the thickness of the workpiece.

To achieve the object, a first aspect of the present invention provides a forming method of forming a plate-shaped workpiece using a female tool having a concave section of a desired shape and a male tool which matches with the female tool, including the steps of: providing an elastic punch in a cylindrical holder provided in the male tool; pressurizing and compressing the elastic punch relatively by a pressuring member; pressing the holder against the workpiece by means of one portion of the elastic punch; and projecting one portion of the elastic punch from the holder so as to deform a portion of the workpiece to be processed according to the shape of the concave section of the female tool so that the workpiece is formed in a state such that the workpiece is nipped pressingly between the female tool and the holder.

A second aspect of the invention provides a forming tools, comprising: a female tool having a concave section of a desired shape; a cylindrical holder which can press a workpiece against the female tool; an elastic punch provided in the holder; and a pressurizing member which can pressurize the elastic punch relatively, wherein a pressing force receiving section to receive a pressing force from the elastic punch is provided in one portion of the holder.

A third aspect of the present invention provides the structure of the second aspect that the elastic punch is made of an elastic body such as urethane or rubber.

A fourth aspect of the invention provides the structure of the second or third aspect that the end of the elastic punch has a taper surface which is suitably chamfered.

A fifth aspect of the present invention provides the structure of the second aspect that a taper surface is formed in the pressing force receiving section of the holder.

A sixth aspect of the invention provides the structure of the second or fifth aspect that a section having the pressing force receiving section is exchangeably provided to the main body of the holder.

A seventh aspect of the invention provides the structure of the fifth or sixth aspect that a tilt angle $\alpha$ of the taper surface of the pressing force receiving section is 0° for high pressure, 0° to 45° for intermediate pressure, and 45° to 89° for low pressure.

An eighth aspect of the invention provides a forming tools, comprising: a female tool having a concave section of a desired shape; a casing into which a cylindrical holder which can relatively press a workpiece against the female is mounted movably; an elastic punch mounted in the holder; and a pressurizing member provided to a bottom portion of the casing so as to be able to pressurize the elastic punch in the holder relatively, wherein a pressing force receiving section which receives a pressing force from the elastic punch is provided in one portion of the holder.

A ninth aspect of the invention provides the structure of the eighth aspect that the holder, the elastic punch and the pressurizing member are provided in the casing exchangeably as one unit.

A tenth aspect of the invention provides the structure of the eight aspect that an elastic member is provided between the holder and the bottom portion of the casing.

An eleventh aspect of the invention provides a forming tool, comprising: a female tool having a concave section of a desired shape; a cylindrical holder which can press a workpiece against the female tool; an elastic punch provided in the holder; and a pressurizing member which can relatively pressurizing the elastic punch, wherein a pressing force receiving section, which receives a pressing force from the elastic punch, is provided to one portion of the holder; and an elastic member is provided between the holder and the pressurizing member.

A twelfth aspect of the invention provides a forming tools, comprising: a female tool having a concave section of a desired shape; a cylindrical holder which can press a workpiece against the female tool; an elastic punch provided in the holder; and a pressurizing member which can relatively pressurize the elastic punch, wherein an elastic member is provided between the holder and the pressurizing member.

A thirteenth aspect of the invention provides a forming tools, comprising: a female tool having a concave section of a desired shape; a cylindrical holder which can relatively press a workpiece against the female tool; an elastic punch provided in the holder; and a pressurizing member which can relatively pressurizing the elastic punch, wherein a pressing force receiving section, which receives a pressing force from the elastic punch, is provided to one portion of the holder; and an overload safety apparatus is provided in a female holder supporting the female tool.

A fourteenth aspect of the invention provides an elastic punch to be mounted into a holder in a tool used in a forming process, comprising: a large diameter section; a small diameter section projected from the large diameter section; and a pressing force transmission section, which transmits a pressing force to a pressing force receiving section provided in the holder, is provided in the large diameter section.

A fifteenth aspect of the invention provides the structure of the fourteenth aspect that an end surface of the small diameter section is an elastic punch whose surface is non-flat.

A sixteenth aspect of the invention provides the structure of the fourteenth or fifteenth aspect that a suitable number of grooves are formed in an outer peripheral surface of the large diameter section so as to be provided within a range from an end surface of the large diameter section to the pressing force transmission section.

A seventeenth aspect of the invention provides the structure of the fourteenth, fifteenth or sixteenth aspect that the large diameter section contains lubricant.

An eighteenth aspect of the invention provides the structure of the fourteenth, fifteenth, sixteenth or seventeenth aspect that hardness of the large diameter section is different from that of the small diameter section.

According to the present invention, when a workpiece is formed by the elastic punch according to the shape of the concave section of the female tool, the elastic punch performs the forming process on the workpiece and presses the holder. Therefore, the process of forming the workpiece can be performed in the simple structure.

In addition, single elastic punch can match with plural female tools, and thus a number of forming tools can be reduced. Therefore, on the whole, production can be made at low costs.

Furthermore, even if workpieces are formed into one shape so as to have different thicknesses, it is not necessary to adjust a clearance between the male tool and the female tool according to a change in the thickness of the workpiece. Therefore, the present invention can easily cope with the change in the thickness of the workpiece.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
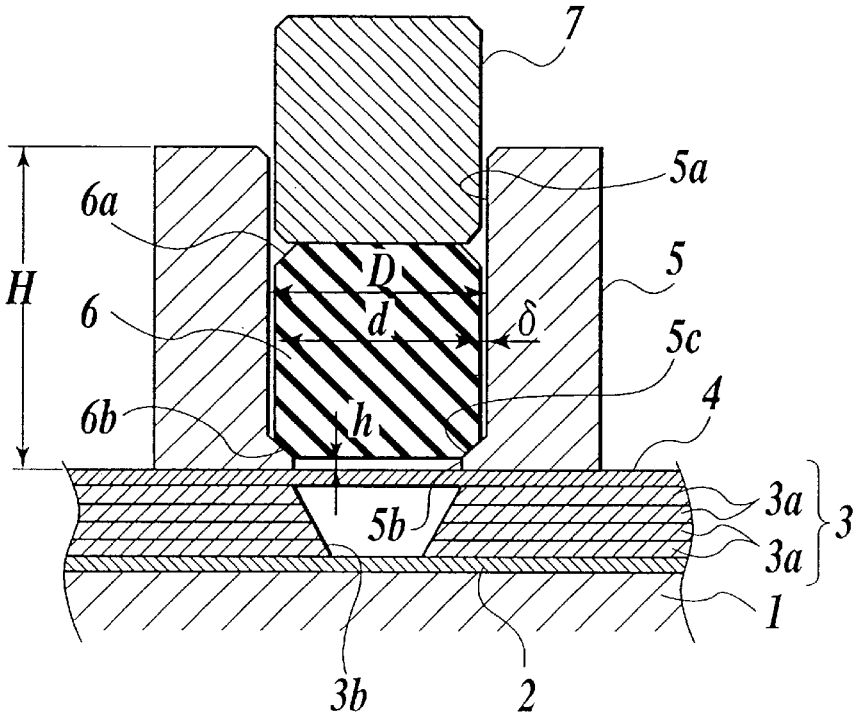
FIG. 1 is a sectional view showing forming tools and a forming method according to an embodiment 1 of the present invention.

There will be detailed below the preferred embodiments of the present invention with reference to the accompanying drawings. Like members are designated by like reference characters.

Figure 2:
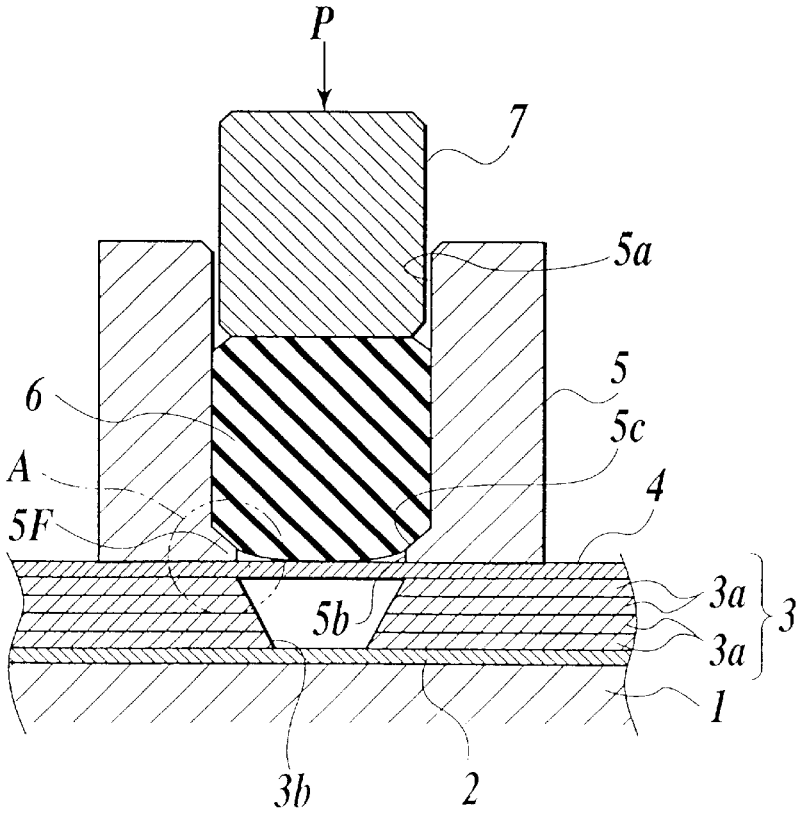
FIG. 2 is a sectional view showing the forming tools and the forming method according to the embodiment 1 of the present invention.
Figure 3:
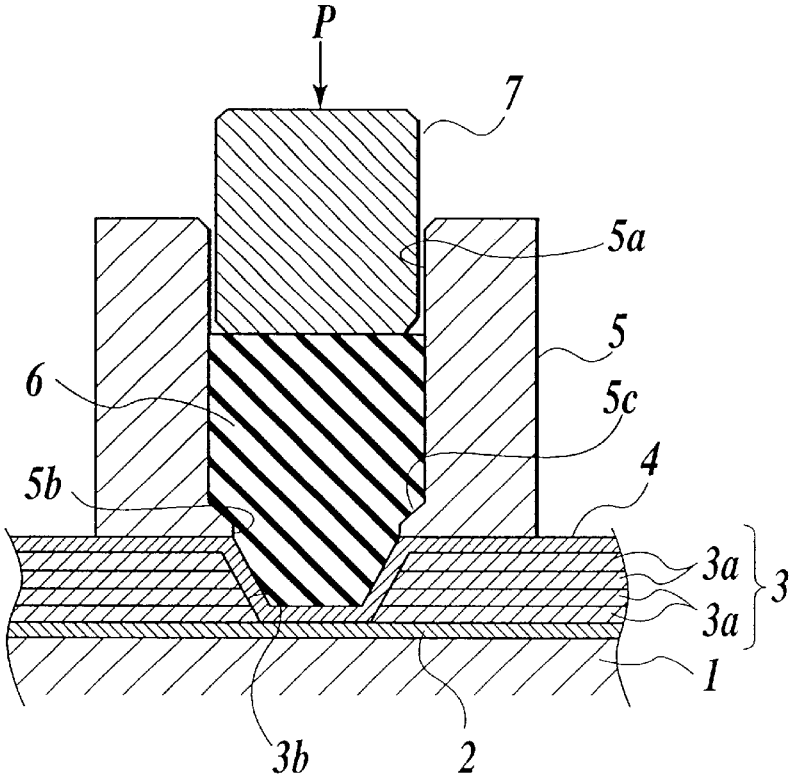
FIG. 3 is a sectional view showing the forming tools and the forming method according to the embodiment 1 of the present invention.
Figure 4:
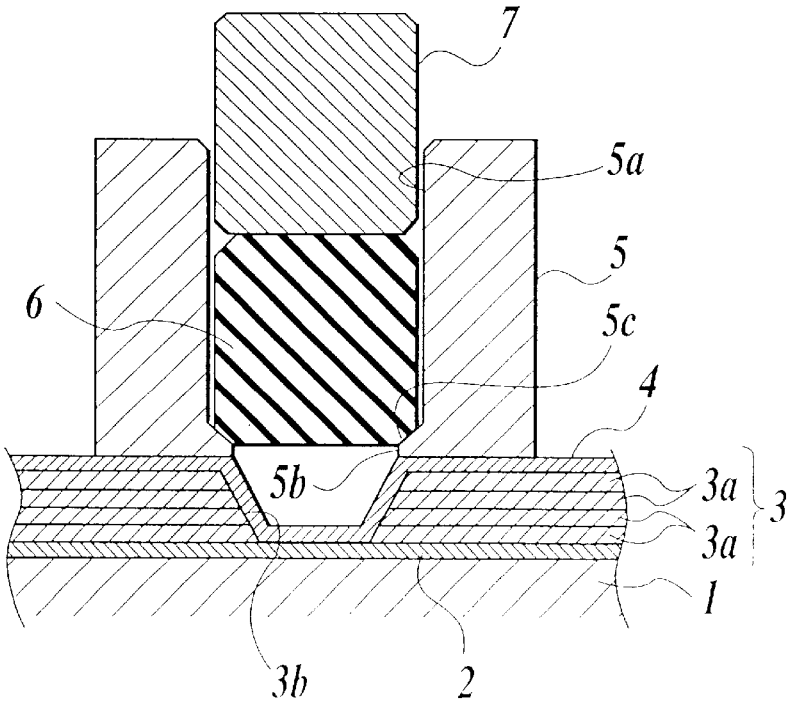
FIG. 4 is a sectional view showing the forming tools and the forming method according to the embodiment 1 of the present invention.
Figure 5:
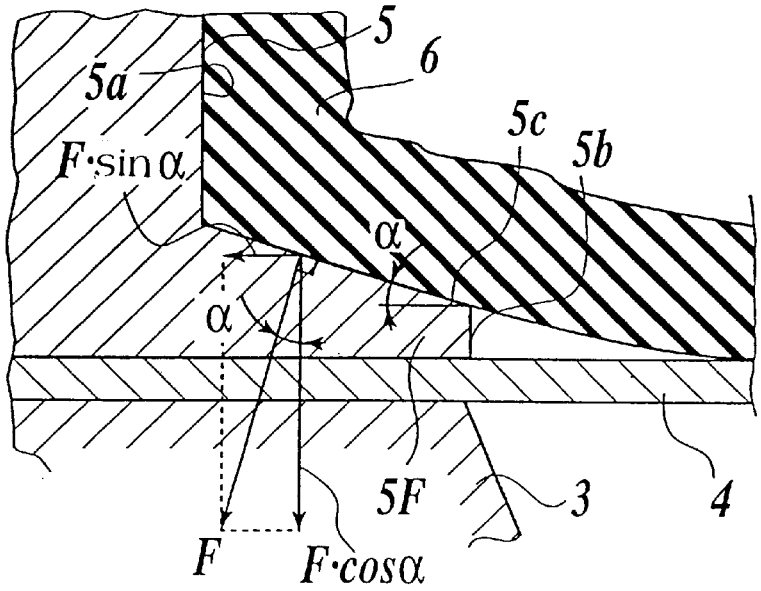
FIG. 5 is a detailed drawing showing an enlarged A portion of FIG. 2.
Figure 6:
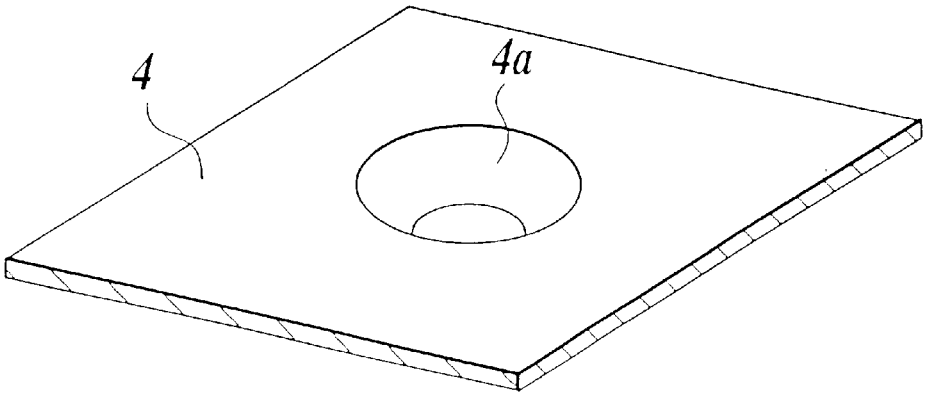
FIG. 6 is a partial perspective view showing a product processed by the forming method according to the present invention.

FIGS. 1 through 4 are sectional views showing the forming method according to the present invention in an order of the steps, as an embodiment 1. FIG. 5 is a detailed drawing showing an enlarged A portion of FIG. 2, and FIG. 6 is a partial perspective view showing a product processed by the forming method according to the present invention.

First, the description will be given as for a basic structure of tools used in the forming process according to the present invention with reference to FIG. 1.

In FIG. 1, a reference numeral 1 is a platen-type bolster in press, namely, a bottom holder corresponding to a bottom turret or the like in turret punching press. A metal plate 2 is set on the bottom holder, and a laminated tool 3 as one example of a female tool is placed so as to be set on the metal plate 2. The laminated tool 3 is formed by laminating plural metal plates 3*a* (four plates in the drawing), and a concave section 3*b* having a desired shape (inverted truncated cone in the present embodiment) is formed in the tool 3.

A metal plate 4, which is a product to be processed (work), is set on the laminated tool 3, and a male tool, which matches with the female tool, is provided on the metal plate 4. Two-stage holes 5*a* and 5*b* having different diameters are bored into a center portion of an approximately cylindrical holder 5 in the male tool in the vertical direction. The holder 5 is made of steel. The circular hole 5*b* having a small diameter is opened on the bottom surface of the holder 5, and the height h of the circular hole 5*b* is set so as to be sufficiently smaller than the overall height H of the holder 5 (h=2 mm in the present embodiment).

Further, a taper surface 5*c*, which is constricted downward (the diameter is reduced), is formed at a joint portion of the circular holes 5*a* and 5*b* having different diameters in the holder 5. As detailed in FIG. 5, a tilt angle $\alpha$ of the taper surface 5*c* is set for 3° to 45° ($\alpha$=12° in the present invention). The portion having the taper surface forms a pressing force receiving section 5F which receives a pressing force from an elastic punch 6 mounted into the holder 5.

In the set state shown in FIG. 1, the holder 5 is located so that the circular hole 5*b* having small diameter, which opens on the bottom surface of the the holder S, comes above the concave section 3*b* of the laminated tool 3. The elastic punch 6, which is formed by an elastic material such as urethane or rubber into an approximately cylindrical shape, is housed in the circular hole 5*a* having large diameter in the holder 5. A cylindrical slide punch 7 is brought into contact with the upper surface of the elastic punch 6. The slide punch 7 is one example of a pressurizing member, which slides up and down relatively in the circular hole 5*a* having large diameter of the holder 5 so as to pressurize the elastic punch 6.

Here, in the set state shown in FIG. 1, an outer diameter d of the elastic punch 6 is set to be smaller than an inner diameter D of the circular hole 5*a* of the holder 5 (d<D), and a predetermined ring-shaped gap $\delta$ is formed between the elastic punch 6 and the holder 5. Moreover, taper surfaces 6*a* and 6*b*, which are constricted upward and downward respectively (diameter is reduced), are formed at upper and lower edges of the outer periphery of the elastic punch 6. The slide punch 7 slides up and down in the holder 5 by a hydraulic press mechanism (not shown), and weight is placed thereon by a desired press.

In such a manner, the laminated tool (female tool) 3, the holder (male tool) 5, the elastic punch 6 and the slide punch 7 as the pressurizing member compose the tools used in the forming process according to the present invention. The forming process which is performed by using the tools will be described below with reference to FIGS. 1 through 6.

In the set state shown in FIG. 1, the hydraulic press (not shown) is driven, and predetermined press weight P is placed on the slide punch 7 by a ram or the like. Then, as shown in FIG. 2, the elastic punch 6 housed in the holder 5 is pressed (pressurized) by the slide punch 7 so as to be elastically deformed (compressively deformed). The diameter of the elastic punch 6 is increased, and its outer peripheral surface closely contact with the inner peripheral surface of the circular hole 5*a* of the holder 5. Moreover, the taper surface 6*b* formed at the bottom outer periphery of the elastic punch 6 moves smoothly into the circular hole 5*b* having small diameter along the taper surface 5*c* of the holder 5, and the lower portion of the elastic punch 6 is pushed into the circular hole 5*b* of the holder 5 so as to contact with the upper surface of the metal plate 4 as a workpiece, as shown in the drawing.

At this time, since the taper surface 5*c* having the predetermined tilt angle $\alpha$ is formed at the pressing force receiving section 5F of the holder 5, a pressing force F is applied from the elastic punch 6 to the taper surface 5*c* as shown in FIG. 5. Therefore, the holder 5 presses the metal plate 4 by means of a vertical component F·cos $\alpha$ of the pressing force F. As a result, the holder 5 serves also as a crease holder (blank holder).

Here, the holder 5 receives the pressing force from the elastic punch 6 by means of the pressing force receiving section 5F, and thus the workpiece 4 is nipped pressingly between the holder 5 and the female tool 3. The nipping pressure becomes stronger when the pressurizing force of the slide punch 7 becomes stronger and the elastic punch 6 is compressed strongly. Therefore, when the pressing force which is applied to the elastic punch 6 from the slide punch 7 becomes stronger, the nipping pressure becomes stronger.

When the tilt angle of the taper surface 6*a* formed on the upper edge periphery of the elastic punch 6 is changed and the area of the upper surface of the elastic punch 6 (pressure receiving area) is changed, the pressure, which is applied to the upper surface of the elastic punch 6 in the initial process can be adjusted. In the case where the pressure is increased, for example, the tilt angle of the taper surface 6*a* is increased, and the area of the upper surface of the elastic punch 6 (pressure receiving area) is decreased.

When the press weight P is continued being applied to the elastic punch 6, as shown in FIG. 3, the elastic punch 6 is further deformed elastically, and its portion as well as the metal plate 4 is pushed into the concave section 3*b* of the laminated tool 3. For this reason, the elastic punch 6 serves as a punch (rigid body) having a convex shape which matches with the concave section 3*b* of the laminated tool 3, and one portion of the metal plate 4 is plastically deformed according to the shape of the concave section 3*b* of the laminated tool 3 so as to be drawn. At this time, since the pressing force F (see FIG. 5) is applied from the elastic punch 6 to the taper surface 5*c* of the holder 5, as mentioned above, the holder 5 serves also as the crease holder (blank holder) so as to prevent crease from occurring on the metal plate 4.

When the elastic punch 6 is compressed as mentioned above, one portion of the elastic punch 6 goes between the inner peripheral surface of the holder 5 and the outer peripheral surface of the slide punch 7, and thus dragging is apt to occur. However, in the present embodiment, since the taper surface 6*a* suitably chamfered is formed on the elastic punch 6, coming of the elastic punch 6 between the holder 5 and the slide punch 7 can be suppressed, and as mentioned above, the dragging can be prevented.

After the metal plate 4 is drawn into a desired shape in the above manner, the press weight P is removed therefrom. As a result, as shown in FIG. 4, the elastic punch 6 made of an elastic material is returned to the original state (set state shown in FIG. 1). Therefore, when the same steps are repeated, the concave section 4*a* shown in FIG. 6 can be formed continuously on the metal plate 4 by the drawing process. In the forming method according to the present embodiment, flaw or the like does not occur on the metal plate 4, but film, tape or the like is provided between the metal plate 4 and the holder 5 so that damage on the metal plate 4 due to the pressing force from the holder 5 can be prevented securely.

As mentioned above, in the present embodiment, the metal plate 4 as a workpiece is provided between the laminated tool 3 and the elastic punch 6, and the elastic punch 6 is pressed so as to be elastically deformed. Moreover, one portion of the elastic punch 6 as well as the metal plate 4 is pushed into the concave section 3*b* of the laminated tool 3, and as a result, the drawing process is performed on the metal plate 4 according to the shape of the concave section 3*b* of the laminated tool 3. For this reason, the elastic punch 6 serves as the punch (male tool) in the pressing process, and thus in manufacturing a small quantity and various types of products, the process for drawing the products into a desired shape can be easily performed for a short time at low costs without using expensive tools used in the pressing process.

Figure 7:
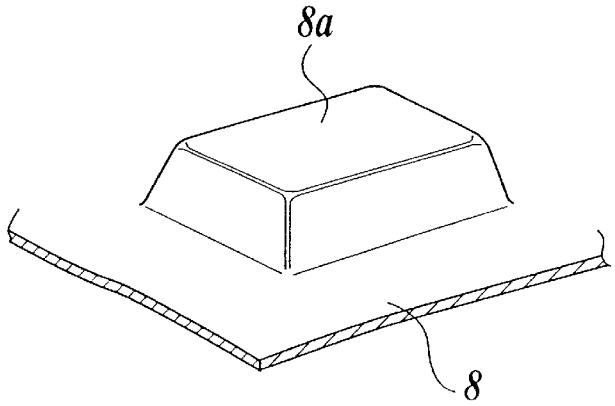
FIG. 7 is a partial perspective view showing an example of the product processed by the forming method according to the present invention.
Figure 8:
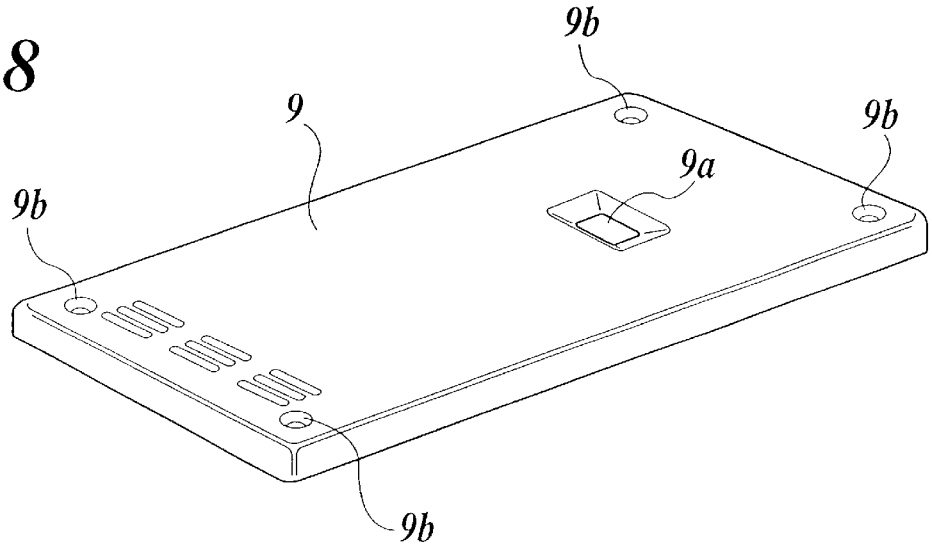
FIG. 8 is a partial perspective view showing an example of the product processed by the forming method according to the present invention.
Figure 9:
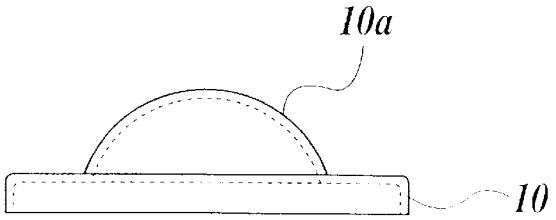
FIG. 9 is a partial perspective view showing an example of the product processed by the forming method according to the present invention.

Therefore, even if the punch as the male tool is used in common for various types of produces, for example, as shown in FIG. 7, a rectangular convex section 8*a* can be formed on a metal plate 8, or as shown in FIG. 8, a rectangular concave section 9*a* and a machine screw washer 9*b* having small diameter can be formed on a metal plate 9 by variously changing the shape of the concave section in the die as the female tool. Further, as shown in FIG. 9, a hemispheric convex section 10*a* can be formed on a metal plate 10. Namely, single punch (male tool) can match with plural dies (female tools).

In addition, in the present embodiment, since the taper surface 5*c* having the predetermined tilt angle $\alpha$ is formed on the pressing force receiving section 5F of the holder 5, the holder 5 presses the metal plate 4 against the female tool so that the metal plate 4 is nipped pressingly by the vertical component $F \cdot \alpha$ of the pressing force F which is applied from the elastic punch 6 to the taper surface 5*c*. As a result, since the holder 5 serves also as the crease holder (blank holder), a special crease holder is not required. Therefore, the structure of the forming tools is simplified, and the cost can be reduced easily.

<Embodiment 2>

Figure 10:
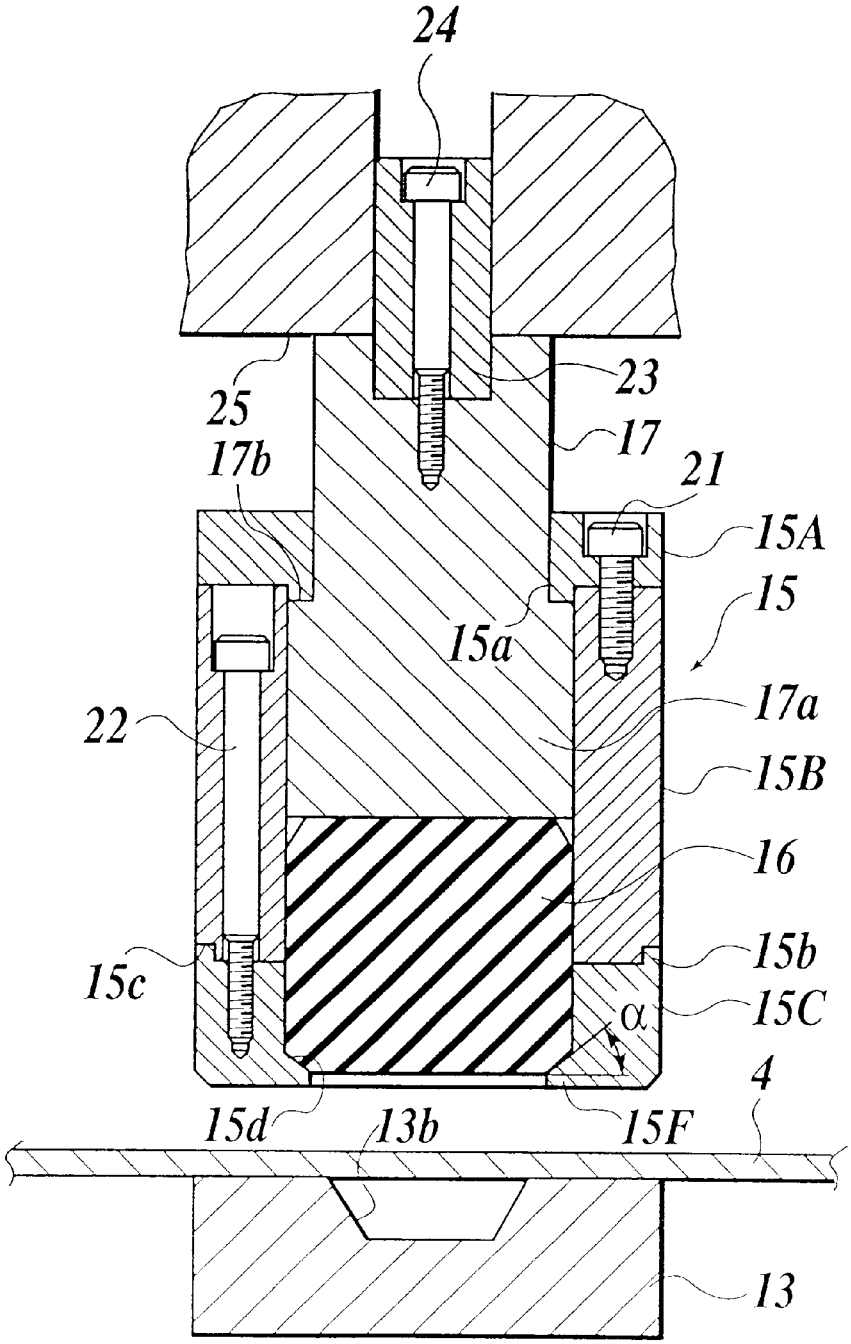
FIG. 10 is a sectional view showing forming tools according to an embodiment 2 of the present invention.

The following will describe the forming tools according to an embodiment 2 of the present invention with reference to FIG. 10.

FIG. 10 is a sectional view of the forming tools according to the present embodiment. The forming tools have a die 13 composing a die as a female tool and a punch as a male tool provided above the die 13. The punch includes an approximately cylindrical holder 15, a cylindrical elastic punch 16 and a slide punch 17 as a pressurizing member. A concave section 13*b* having a desired shape (inverted truncated cone in the present embodiment) is formed on the upper surface of the die 13.

The holder 15 is divided into three parts: a slide holder section 15A, a cylindrical holder main body 15B and a crease holder section 15C. The slide holder section 15A is detachably mounted to the upper portion of the holder main body 15B, and the crease holder section 15C is detachably mounted to the lower portion.

Namely, the slide holder section 15A, which is formed into a ring shape, is mounted to the upper portion of the holder main body 15B by means of plural bolts 21 (only one is shown in FIG. 10) so that a convex section 15*a* bored into the lower inner periphery is fitted and located into the upper end periphery of the holder main body 15B. Moreover, the crease holder section 15C is mounted to the lower portion of the holder main body 15B by means of plural bolts 22 (only one is shown in FIG. 10) so that a ring-shaped convex section 15*b* projected on the upper outer periphery of the crease holder section 15C is fitted and located in a ring-shaped concave section 15*c* formed on the lower outer periphery of the holder main body 15B.

A pressing force receiving section 15F having a taper surface 15*d*, which is constricted downward, is formed in the crease holder section 15C of the holder 15.

In addition, similarly to the embodiment 1, the elastic punch 16 is made of an elastic material such as urethane or rubber. The slide punch 17 is formed so as to have two-stage cylindrical portions having large and small diameters respectively, and a large-diameter section 17*a* at its lower half portion is fitted into the holder 15. The lower surface of the slide punch 17 contacts with the upper surface of the elastic punch 16, and an uneven section 17*b* contacts with the slide holder section 15A of the holder 15. Therefore, the slide punch 17, the holder 15 and the elastic punch 16 integrally move up and down until the crease holder section 15C is brought into contact with the workpiece 4.

The slide punch 17 is mounted to a ram 25, which moves up and down in a pressing apparatus, at the upper end portion of the slide punch 17 by a shank 23 and a bolt 24. As shown in the drawing, in the set state that the metal plate 4 as a material to be processed (work) is placed on the die 13 as a female tool, the ram 25 of the pressing apparatus is driven so that the slide punch 17, the holder 15 and the elastic punch 16 in the punch as a male tool move up and down. As a result, the lower end surface of the holder 15 (crease holder section 15C) contacts with the metal plate 4 so as to be stopped, and thereafter the slide punch 17 is further moves down relatively. Then, the elastic punch 16 is pressed (pressurized) by the slide punch 17 so as to be elastically deformed (compressively deformed), and similarly to the embodiment 1, the elastic punch 16 serves as the punch (rigid body) having a convex shape matching with the concave section 13*b* of the die 13. One portion of the metal plate 4 is plastically deformed according to the shape of the concave section 13*b* of the die 13 so as to be drawn. Therefore, a concave section 4*a* shown in FIG. 6 is formed on the metal plate 4.

In the above compressing step, the crease holder section 15C of the holder 15 is pressed against the metal plate 4 by the vertical component $F \cdot \cos\alpha$ (see FIG. 5) of the force F applied from the elastic punch 16 to the taper surface 15*d* having the predetermined tilt angle $\alpha$ in the pressing force receiving section 15F so as to prevent crease from occurring on the metal plate 4.

The force (pressing force), which is generated when the crease holder section 15C of the holder 15 presses the metal plate 4, varies according to a thickness and a material of the metal plate 4, but the pressing force can be adjusted by changing the tilt angle $\alpha$ of the taper surface 15*d* of the crease holder section 15C. More specifically, as the tilt angle $\alpha$ of the taper surface 15*d* is set to greater values, the pressing force $F \cdot \cos\alpha$ can be increased.

In the present embodiment, since the holder 15 is divided and the crease holder section 15C is detachably mounted to the holder main body 15B, the crease holder section 15C can be easily exchanged. For example, as shown in FIG. 11, three types of crease holder sections 15C, 15C' and 15C" where the tilt angles $\alpha$ of the taper surface 15*d* are different are prepared, the suitable one is selected from them according to the thicknesses and materials of the metal plate 4, and the selected crease holder section may be mounted to the holder main body 15B.

Figure 11A:
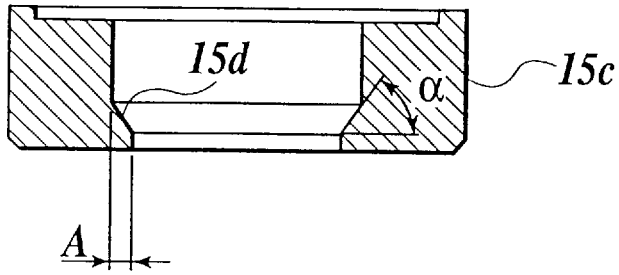
FIGS. 11A, 11B and 11C are sectional views showing various embodiments of a crease holding section of a holder.
Figure 11B:
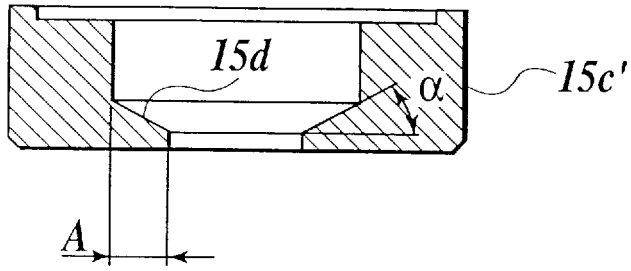
Figure 11C:
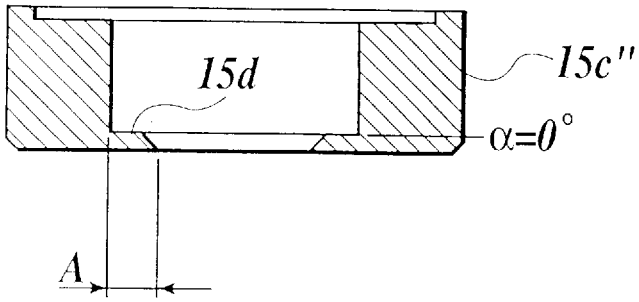

Here, FIG. 11(*a*) shows the low-pressure-use crease holder section 15C where tilt angle $\alpha$ of the taper surface 15*d* has been set for 45° to 89°, FIG. 11(*b*) shows the intermediate pressure use crease holder section 15C' where the tilt angle α of the taper surface 15*d* has been set for 0° to 45°, and FIG. 11(*c*) shows the high-pressure-use crease holder section 15C" where the tilt angle α of the taper surface 15*d* has been set for 0°. Here, the pressing force applied to the metal plate 4 can be adjusted by adjusting a width A, besides the tilt angle α of the taper surface 15*d*.

As mentioned above, according to the forming tools according to the present embodiment, the holder 15 is divided and the crease holder section 15C is mounted to the holder main body 15B exchangeably. As a result, the pressing force applied to the metal plate 4 can be adjusted so as to have a value suitable to the thickness and material of the metal plate 4 by exchanging only the crease holder section 15C without exchanging the whole holder 15. Moreover, since the holder 15 excluding the crease holder section 15C, namely, the slide holder section 15A and the holder main body 15B can be used in common, the cost can be reduced.

Here, needless to say, also in the present embodiment, the effect similar to that in the embodiment 1 can be obtained.

<Embodiment 3>

Figure 12:
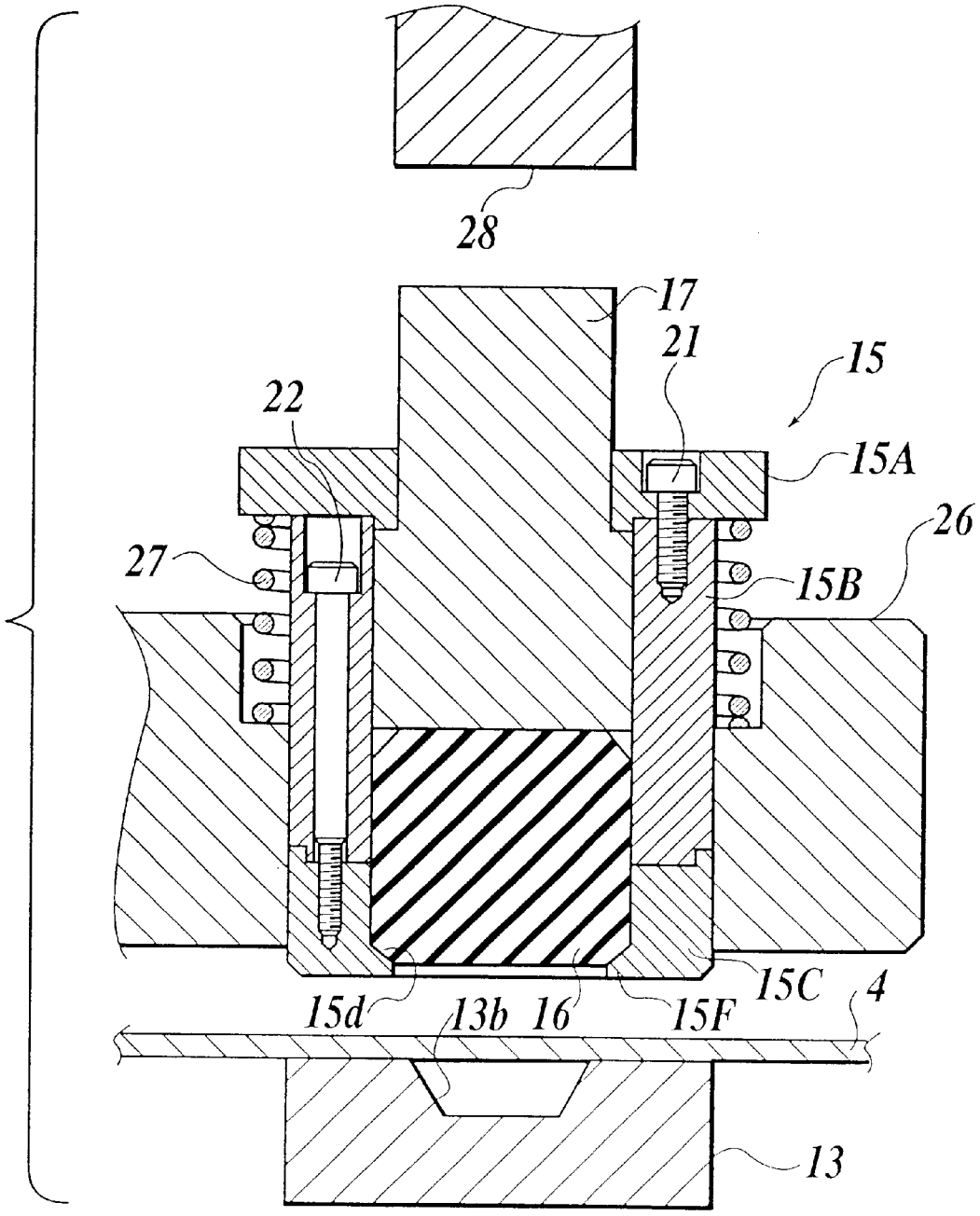
FIG. 12 is a sectional view showing forming tools according to an embodiment 3 of the present invention.

The following will describe the forming tools according to an embodiment 3 of the present invention with reference to FIG. 12. FIG. 12 is a sectional view of the forming tools according to the present embodiment. In this drawing, the components same as those shown in FIG. 10 are represented by the same reference numerals, and thus the description thereof is omitted.

The present embodiment shows an example that the forming tools are mounted to an NC turret punching press so that the forming process is automated, and the basic structure of the forming tools is the same as that in the embodiment 2.

In the present embodiment, the holder 15 in the punch as the male tool, which holds the elastic punch 16 and the slide punch 17, is held to an upper turret 26 of the NC turret punching press so as to be able to move up and down. The outer periphery of the slide holder section 15A of the holder 15 is projected outward from the holder main body 15B so as to form brim sections, and lifter springs 27 are compressively mounted between the brim sections and the upper turret 26 so as to urge the holder 15, the elastic punch 16 and the slide punch 17 upward.

As shown in the drawing, the metal plate 4 as a material to be processed (work) is placed and set on the die 13 as the female tool, and the slide punch 17 is pressed in the punch as the male tool by a striker 28 which moves up and down in the NC turret punch press. As a result, the slide punch 17 as well as the holder 15 and the elastic punch 16 moves downward against the urging force of the lifter springs 27, and the lower end surface of the holder 15 (crease holder section 15C) is brought into contact with the metal plate 4 so as to be stopped.

Thereafter, when the slide punch 17 is further pressed and moves downward relatively, the elastic punch 16 is pressurized by the slide punch 17 so as to be elastically deformed (compressively deformed). Similarly to the embodiment 1 , the elastic punch 16 serves as the punch (rigid body) having a convex shape matching with the concave section 13*b* of the die 13, and one portion of the metal plate 4 is plastically deformed according to the shape of the concave section 13*b* of the die 13 so as to be drawn. As a result, the concave section 4*a* shown in FIG. 6 is formed on the metal 4.

After the metal plate 4 is drawn into a desired shape in such a manner, the striker 28 of the NC turret punching press is moved upward so that weight is removed. As a result, the holder 15, the elastic punch 16 and the slide punch 17 move upward by a fly force of the lifter springs 27 so as to return to the original set state shown in FIG. 12, and thereafter the drawing process on the metal plate 4 can be performed automatically in the same manner.

According to the present embodiment, the effect similar to that in the embodiments 1 and 2 can be obtained. Further, the effect that the forming process can be performed automatically and efficiently can be obtained.

<Embodiment 4>

Figure 13:
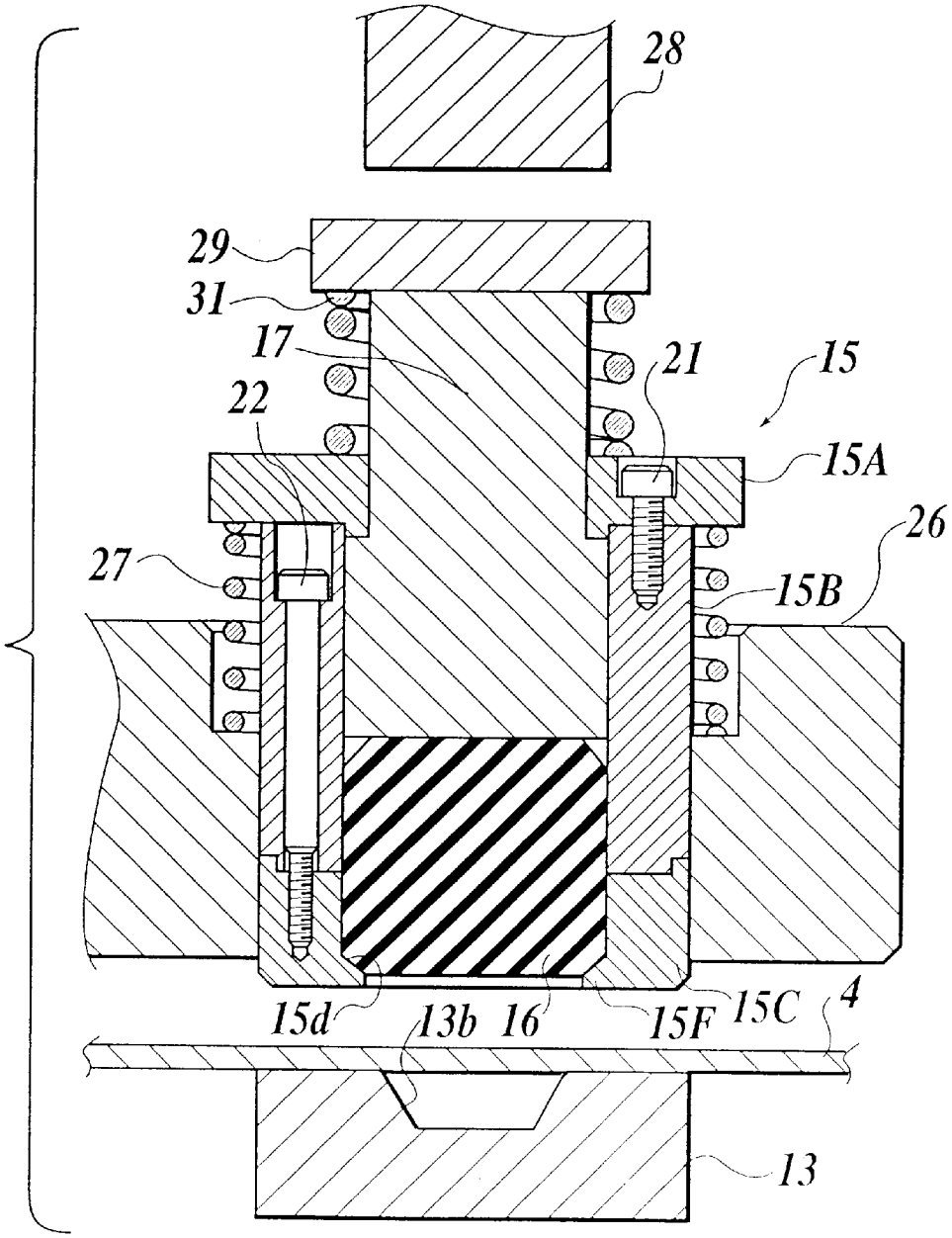
FIG. 13 is a sectional view showing forming tools according to an embodiment 4 of the present invention.

FIG. 13 is an explanatory drawing showing a cross section of the forming tools according to an embodiment 4 of the present invention.

In the present embodiment, a different part from that of the embodiment 3 in FIG. 12 is that powerful elastic members 31 such as a coil spring or urethane rubber are provided between a punch head 29, which is integrally provided above the slide punch 17 as a pressurizing member in the punch as the male tool, and the holder 15.

In the above structure, when the striker 28 is lowered and thus the slide punch 17 as the pressurizing member is lowered so as to pressurize the elastic punch 16, the elastic members 31 are also pressurized. Therefore, the force, which is generated when the holder 15 presses (pressurizes) the workpiece 4 against the die 31, becomes the sum of the pressing force applied from the elastic punch 16 to the holder 15 and the the pressing force applied from the elastic members 31 to the holder 15 so as to be increased.

Namely, in the above-mentioned structure, when the pressing force applied from the elastic punch 16 to the holder 15 is weak, the elastic members 31 assist in pressing the holder 15. Accordingly, this structure is effective in the case where the pressing force applied from the elastic punch 16 to the holder 15 cannot be increased.

<Embodiment 5>

Figure 14:
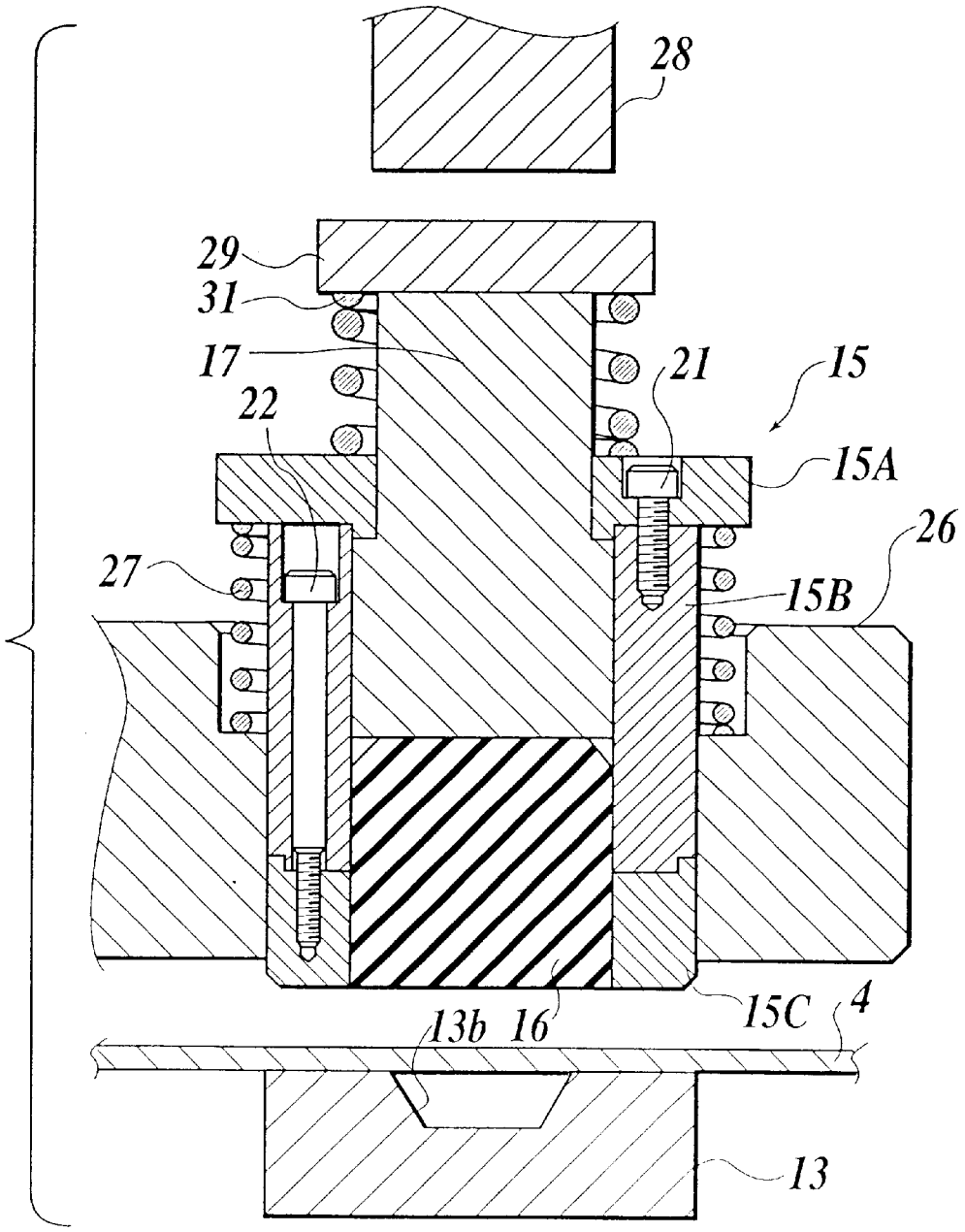
FIG. 14 is a sectional view showing forming tools according to an embodiment 5 of the present invention.

FIG. 14 is an explanatory drawing showing a cross section of the forming tools according to an embodiment 5 of the present invention.

In the present embodiment, a different part from that in the embodiment 4 shown in FIG. 13 is that the pressing force receiving section 15F is removed from the crease holder section 15C in the holder 15 in the punch as the male tool, and the lower surface of the elastic punch 16 is approximately level with the lower surface of the crease holder section 15C.

In the above-mentioned structure, since the holder 15 presses (pressurizes) the workpiece 4 against the die 13 by means of the pressing force applied from the elastic members 31, when elastic coefficient of the elastic members 31 is increased so that the elastic members 31 are further powered, the effect same as that in the aforementioned embodiments can be obtained easily.

In this structure, since the pressing force receiving section 15F is omitted, the holder 15 can be formed into a straight pipe form. As a result, a pipe material or the like can be utilized, and thus the production can be made easily.

<Embodiment 6>

Figure 15:
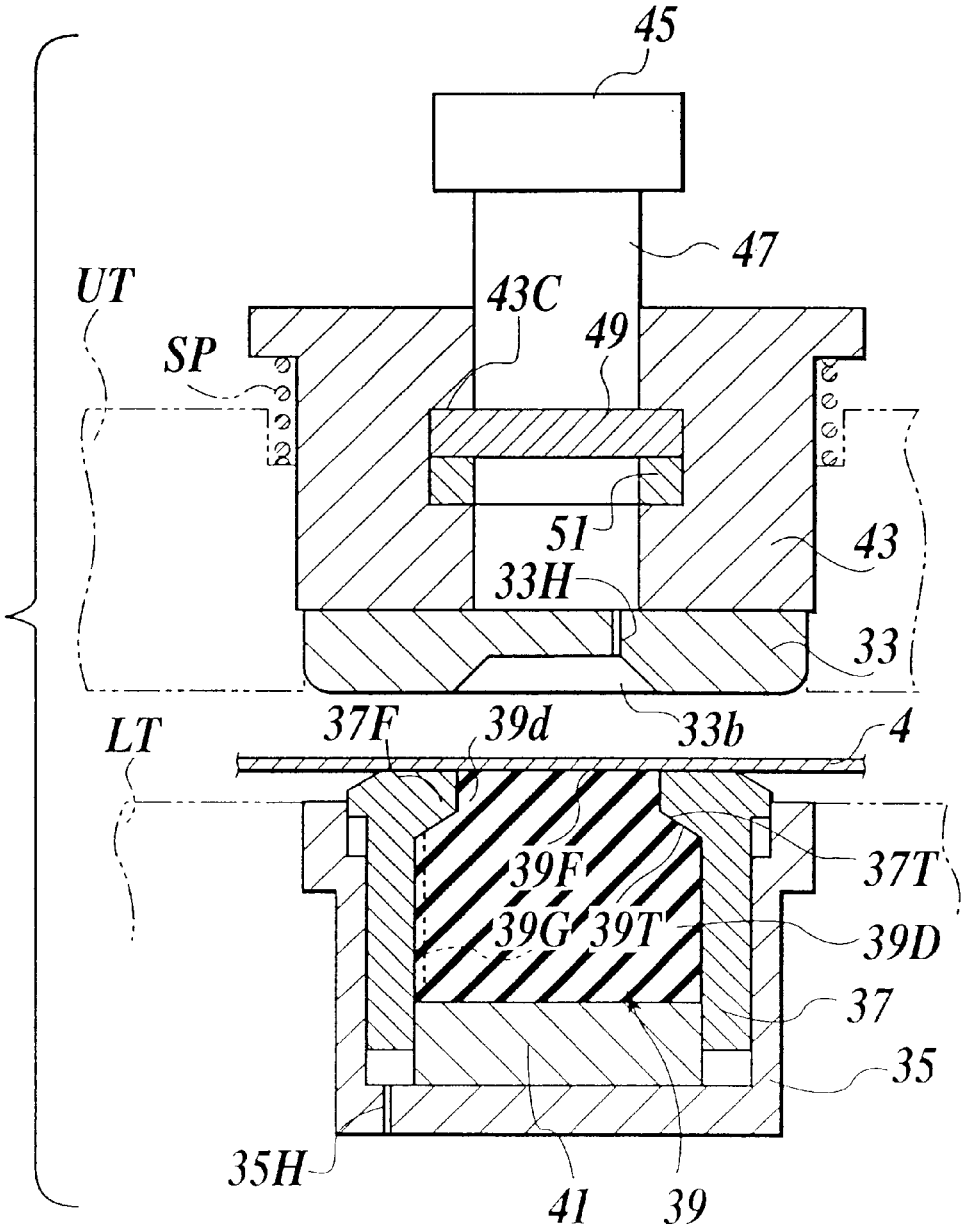
FIG. 15 is a sectional view showing forming tools according to an embodiment 6 of the present invention.

FIG. 15 is an explanatory drawing showing a cross section of the forming tools according to an embodiment 6 of the present invention.

In the present embodiment, a female tool 33 having a concave section 33*b* of a desired shape is provided to a punch, and a male tool which cooperates with the female tool 33 is provided to a die. Namely, the die has a casing 35 which is supported to a lower turret LT in a turret punching press (not shown), for example, and a cylindrical holder 37, which can relatively press the workpiece 4 against the female tool 33, is mounted into the casing 35 so as to be able to move up and down relatively.

Figure 16:
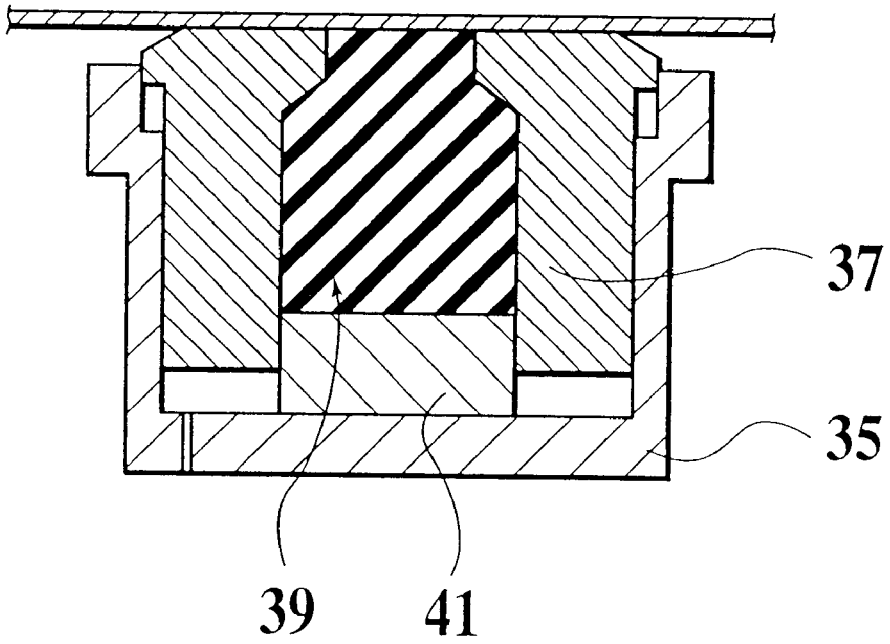
FIG. 16 is a sectional view showing forming tools according to an embodiment 7 of the present invention.

An elastic punch 39, which is made of an elastic body such as urethane rubber or rubber, is mounted into the holder 37, and a pressurizing member 41, which can relatively pressurize (press) the elastic punch 39, is provided between the lower surface of the elastic punch 39 and the bottom portion of the casing 35. The holder 37, the elastic punch 39 and the pressurizing member 41 as a unit are mounted to the casing 35 so as to be exchangeable. Therefore, as shown in FIG. 16, for example, the holder 37, the elastic punch 39 and the pressurizing member 41 can be exchanged with suitable ones according to a thickness, material and forming shape of the workpiece 4.

The elastic punch 39 has a large diameter section 39D whose diameter is approximately equal with the inner diameter of the holder 37, and has a small diameter section 39*d*, whose diameter is approximately equal with an inner diameter of a pressing force receiving section 37F formed in the holder 37, so as to be projected from the large diameter section 39D. Moreover, the large diameter section 39D has a taper surface-formed pressing force transmission section 39T whose surface contacts with a taper surface 37T of the pressing force receiving section 39F in the holder 37.

Further, suitable number of grooves 39G are formed on the outer peripheral surface of the large diameter section 39D in the elastic punch 39 so as to be provided within a range from the end of the elastic punch 39 to the pressing force transmission section 39T. The grooves 39G are used for leading air to a contact portion of the taper surface 37T of the holder 37 with the pressing force transmission section 39T of the elastic punch 39 so as to prevent close contact on the contact portion.

Figure 17A:
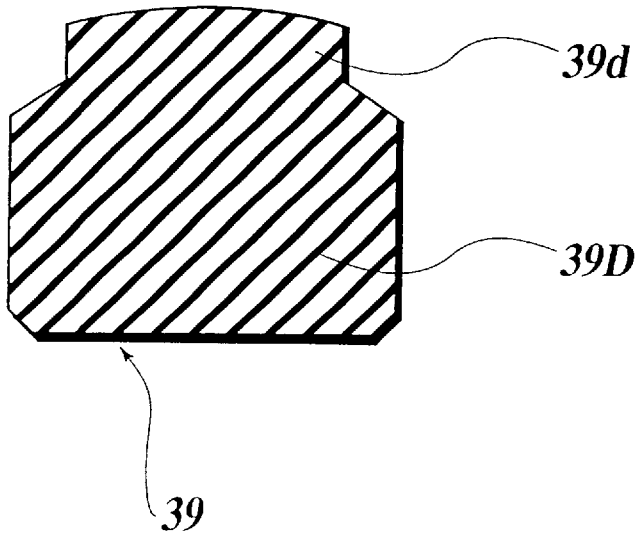
FIG. 17 is a sectional explanatory view of an elastic punch according to the present invention.
Figure 17B:
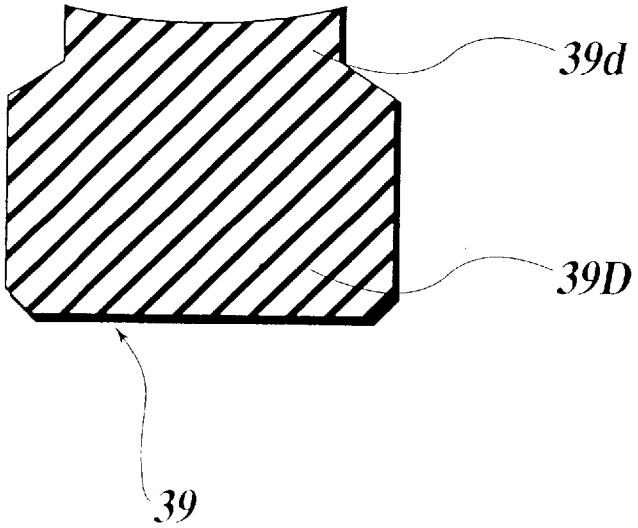

An end surface 39F of the small diameter section 39*d* in the elastic punch 39 is formed into a flat surface form, but it is desirable that the shape of the end surface matches with the concave section 33*b* so that the workpiece 4 is deformed accurately according to the shape of the concave section 33*b* of the female tool 33. However, as shown in FIGS. 17(A) and 17(B), for example, a non-flat surface shape such as a convex spherical surface or a concave spherical surface is desirable as a general-purpose shape of some degree.

In addition, it is desirable that the elastic punch 39 contains lubricant such as molybdenum in order to reduce friction between the holder 37 and the inner peripheral surface. In this case, since the contact area of the outer peripheral surface of the large diameter section 39D of the elastic punch 39 with the inner peripheral surface of the holder 37 is large, it is desirable that the lubricant is contained only in the outer peripheral portion of the large diameter section 39D in order to reduce the friction of the contact portion. Further, it is desirable that the hardness of the large diameter section 39D is different with that of the small diameter section 39*d* in the elastic punch 39, and the pressing force can be transmitted sufficiently from the elastic punch 39 to the holder 37. Moreover, it is desirable that the small diameter section 39d is projected from the holder 37 so as to press the workpiece 4 sufficiently along the concave section 33*b* of the female tool 33.

The punch, which matches with the die as the male tool, has a female holder 43 which is supported to the upper turret UT in the turret punching press (not shown) via lifter springs SP so as to be able to move up and down. The female tool 33 is exchangeably mounted to the lower surface of the female holder 43 via plural bolts (not shown). Here, a suitable number of air bleeding holes H having a small diameter are provided in the concave section 33*b* of the female tool 33.

A shank 47, which is fitted into the upper end of the punch head 45 so that its vertical position can be adjusted, is provided in the female holder 43 so as to be movable up and down relatively. The lower end of the shank is provided into a concave section 43C formed in the female holder 43, and a shear plate 49 is exchangeably mounted to the lower end of the shank section 47 via a mounting bolt (not shown). Moreover, a ring-shaped die plate 51 is provided between the shear plate 49 and the bottom portion of the concave section 43C.

When the punch head 45 is pressurized downward and thus overload is generated, the shear plate 49 is drawn out by the die plate 51 and the shank 47 so as to prevent occurrence of further overload. The shear plate 49, the die plate 51 and the like compose an overload safety apparatus.

The structure of the overload safety apparatus is not limited to the structure composed of the aforementioned shear plate 49, the die plate 51 and the like. Therefore, the overload safety apparatus may have the structure that the concave section 43C is sealed, for example. In this structure, fluid in the concave section 43C is compressed by the shank 47 at the time of generation of overload so that the pressure becomes high, and when the pressure exceeds a prescribed value, the fluid is discharged outside via a relief valve.

Figures 18A, 18B, 18C, 18D:
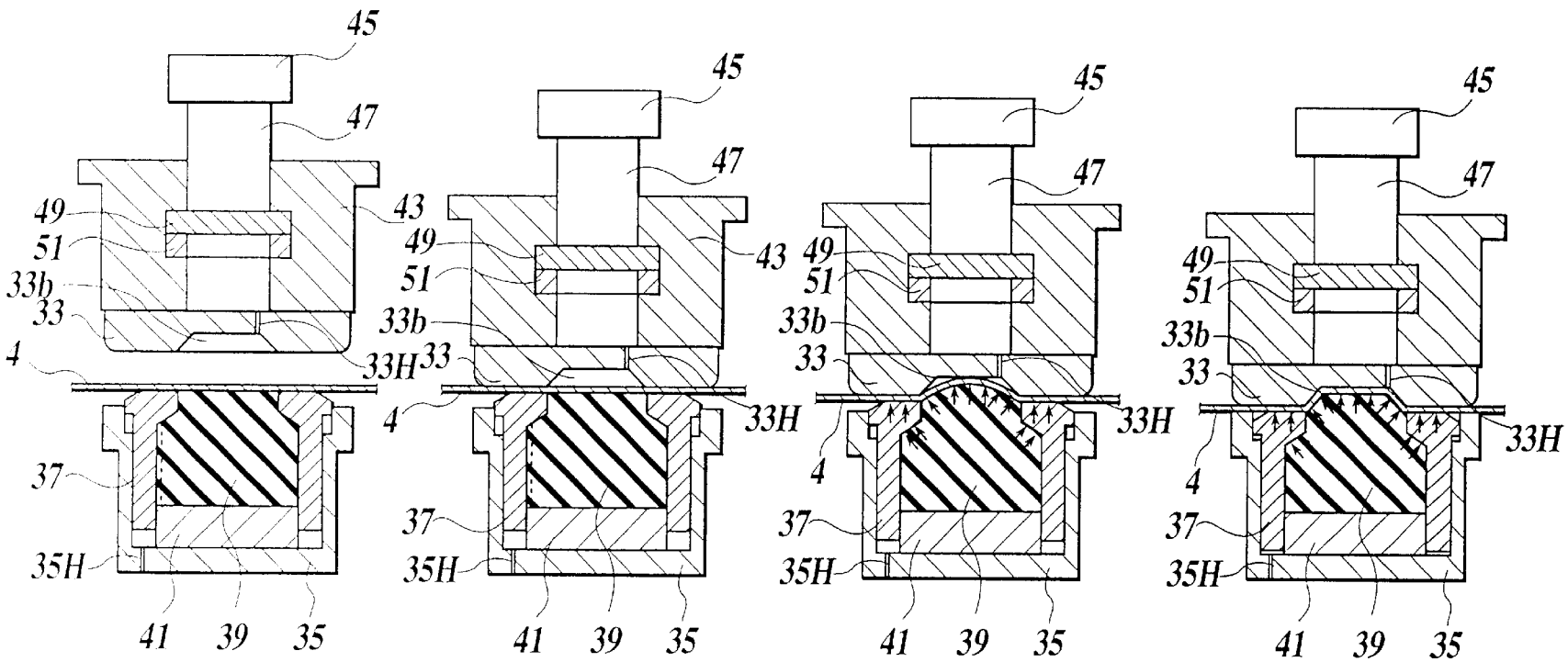
FIGS. 18A, 18B, 18C and 18D are explanatory drawings showing steps of the forming process using the forming tools according to the embodiment 6 of the present invention.

In the aforementioned structure, as shown in FIG. 18(A), after the workpiece 4 is placed and located on the upper surface of the holder 37 in the die as the male tool, the ram or the striker (not shown) in the punching press is lowered so that the punch head 45 in the punch as the female tool is lowered by the striker. As a result, the female holder 43 is lowered against the lifter springs SP via the shank 47, the stripper plate 49 and the die plate 51, and the female tool 33 is brought into contact with the workpiece 4 as shown in FIG. 8(B).

After the lower surface of the female tool 33 in the punch is brought into contact with the upper surface of the workpiece 4, the punch head 45 is further lowered by the striker. As a result, while the workpiece 4 is nipped between the upper surface of the holder 37 and the female tool 33, the holder 37 compresses the elastic punch 39 and simultaneously is lowered relatively.

When the holder 37 compresses the elastic punch 39 and simultaneously is lowered relatively in the above manner, the elastic punch 39 is compressed relatively by the pressurizing member 41 so as to be projected upward relatively from the holder 37 as shown in FIG. 18(C). Then, the elastic punch 39 presses the workpiece 4 into the concave section 33*b* of the female tool 33, and finally the workpiece 4 is formed according to the shape of the concave section 33*b* as shown in FIG. 18(D). Thereafter, when the striker is returned to the original position, the punch is raised to the original position by an action of the lifter springs SP. Moreover, when the elastic punch 39 in the die is returned to the original state, the die is returned to the original state.

Since the air bleeding holes 33H having small diameter are provided in the concave section 33*b*, and air bleeding holes 35H are provided also in the bottom portion of the casing 35, when the workpiece is formed in the aforementioned manner, the holder 37 is lowered smoothly, and the workpiece 4 is moved into the concave section 33*b* so as to be deformed therein smoothly.

Furthermore, since the elastic punch 39 contains lubricant, and friction between the holder 37 and the elastic punch 39 is weak, the elastic punch 39 moves in the holder 37 smoothly. As a result, the elastic punch 39 moves towards the concave section 33*b* of the female tool 33 smoothly, and thus the elastic punch 39 functions effectively in the process of forming the workpiece 4.

According to the present embodiment, the workpiece 4 can be easily formed into a convex shape in the upper direction.

<Embodiment 7>

Figure 19:
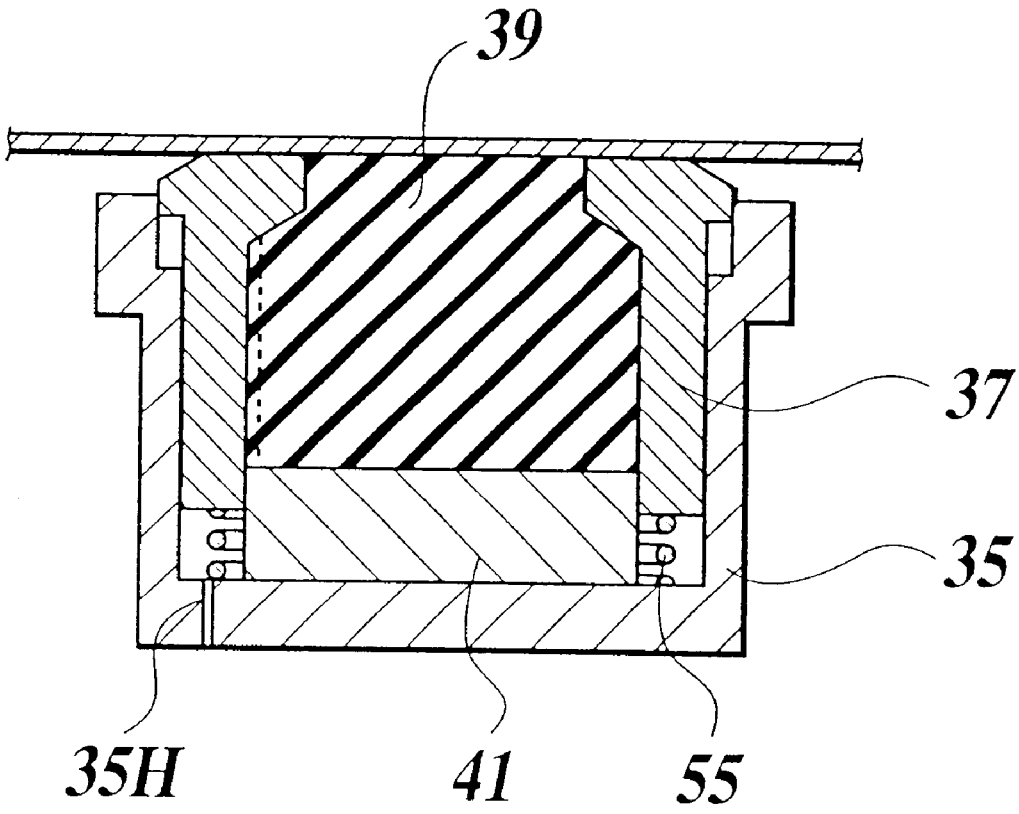
FIG. 19 is a sectional explanatory view showing forming tools according to an embodiment 8 of the present invention.

FIG. 19 is an explanatory drawing showing a sectional view of the forming tools according to an embodiment 7 of the present invention.

In the present embodiment, a different part from the structure of the die as the male tool shown in FIG. 15 is that elastic members 55, such as urethane rubber, a belleville spring or a coil spring, are provided between the lower portion of the holder 37 and the bottom portion of the casing 35.

In the above structure, the force, which is generated when the holder 37 presses (pressurizes) the workpiece 4 relatively, becomes the sum of the pressing force applied from the elastic punch 39 to the holder 37 and the pressing force applied from the elastic members 55 to the holder 37 so as to be a great pressing force.

While preferred embodiments of the present invention have been described using specific terms, such description is for illustrative purposes, and it is to be understood that changes and variations may be made without departing from the spirit or scope of the following claims.

What is claimed is:

1. A forming tool, comprising a female tool having a concave section of desired shape;

a cylindrical holder which can press a workpiece against the female tool;

an elastic punch provided in the holder; and a pressurizing member which can pressurize the elastic punch relatively, wherein a pressing force receiving section to receive a pressing force from the elastic punch is provided in the one portion of the holder, wherein a tapered surface is formed in the pressing force receiving section of the holder, wherein the cylindrical holder has a bottom surface for contacting the workpiece, the bottom surface having a hole formed therein, the hole having a non-zero height measured between the bottom surface and the tapered portion.

2. A forming tool, comprising a female tool having a concave section of desired shape;

a cylindrical holder which can press a workpiece against the female tool;

an elastic punch provided in the holder; and a pressurizing member which can pressurize the elastic punch relatively, wherein a pressing force receiving section to receive a pressing force from the elastic punch is provided in the one portion of the holder, wherein the cylindrical holder has a hole formed therein of inner diameter D; and when the pressurizing member does not pressurize the elastic punch, the elastic punch is disposed in the hole and has an outer diameter $d<D$ to define a ring-shaped gap between the elastic punch and the hole.

* * * * *